US012509749B2

(12) United States Patent
Ye et al.

(10) Patent No.: US 12,509,749 B2
(45) Date of Patent: Dec. 30, 2025

(54) NON-HEAT TREATED ALUMINUM ALLOY STRESS-BEARING MEMBER MATERIAL WITH HIGH TOUGHNESS AND HIGH CASTING PERFORMANCE AND PREPARATION METHOD THEREOF

(71) Applicants: Baoding Lizhong Wheel Manufacturing Co., Ltd, Baoding (CN); Hebei New Lizhong Nonferrous Metals Group Co., Ltd, Baoding (CN); Baoding Longda Aluminum Co., Ltd, Baoding (CN)

(72) Inventors: Zhen Ye, Baoding (CN); Xuefeng Cao, Baoding (CN); Changqing Zheng, Baoding (CN); Sainan Miao, Baoding (CN); Yawei Zhou, Baoding (CN); Shaowen Zhang, Baoding (CN); Zhenzhou Liang, Baoding (CN); Quan Li, Baoding (CN); Liandi Xu, Baoding (CN)

(73) Assignees: Baoding Lizhong Wheel Manufacturing Co., Ltd, Baoding (CN); Hebei New Lizhong Nonferrous Metals Group Co., Ltd, Baoding (CN); Baoding Longda Aluminum Co., Ltd, Baoding (CN)

( * ) Notice: Subject to any disclaimer, the term of this patent is extended or adjusted under 35 U.S.C. 154(b) by 441 days.

(21) Appl. No.: 18/099,327

(22) Filed: Jan. 20, 2023

(65) Prior Publication Data

US 2023/0160041 A1 May 25, 2023

Related U.S. Application Data

(63) Continuation of application No. PCT/CN2022/117142, filed on Sep. 6, 2022.

(51) Int. Cl.

| | |
|---|---|
| ***C22C 21/02*** | (2006.01) |
| ***B22D 21/00*** | (2006.01) |
| ***C22C 1/02*** | (2006.01) |
| ***C22C 1/03*** | (2006.01) |

(52) U.S. Cl.

CPC ..... *C22C 21/02* (2013.01); *B22D 21/007* (2013.01); *C22C 1/026* (2013.01); *C22C 1/03* (2013.01)

(58) Field of Classification Search

CPC ..... C22C 21/02; C22C 21/04; C22C 1/026; C22C 1/03

See application file for complete search history.

(56) References Cited

U.S. PATENT DOCUMENTS

| | | | | |
|---|---|---|---|---|
| 5,055,255 | A * | 10/1991 | Scott | C22C 21/04 148/438 |
| 2011/0027610 | A1 | 2/2011 | Tatsumi et al. | |
| 2021/0087654 | A1 | 3/2021 | Maruyama et al. | |
| 2022/0127701 | A1 | 4/2022 | Kurosaki et al. | |

* cited by examiner

*Primary Examiner* — Jessee R Roe
(74) *Attorney, Agent, or Firm* — Zhigang Ma

(57) ABSTRACT

The present disclosure relates to the technical field of metal materials, and more specifically, to a non-heat treated aluminum alloy stress-bearing member material with high toughness and high casting performance and its preparation method. The non-heat treated aluminum alloy stress-bearing member material with high toughness and high casting performance includes the following components in terms of mass percentage: Si: 8.5-12.0%, Mg: 0.10-0.35%, Mn: 0.25-0.4%, Cr: 0.02-0.14%, V: 0.02-0.38%, Sr: 0.01-0.04%, Ti: 0.05-0.11%, B≤0.005%, Ca≤0.05%, Zr≤0.1%, Zn≤0.1%, RE≤0.1%. The total amount of other impurities is less than or equal to 0.25%, and the balance is Al. Under the premise of ensuring that the alloy has good die casting performance, the die-casting parts in non-heat-treated state can have excellent comprehensive mechanical properties, thereby meeting the performance requirements of the die casting stress-bearing member.

7 Claims, 3 Drawing Sheets

NON-HEAT TREATED ALUMINUM ALLOY STRESS-BEARING MEMBER MATERIAL WITH HIGH TOUGHNESS AND HIGH CASTING PERFORMANCE AND PREPARATION METHOD THEREOF

CROSS REFERENCE TO RELATED APPLICATION

This patent application is a continuation application of PCT/CN2022/117142, filed on Sep. 6, 2022, which claims the benefit and priority of Chinese Patent Application No. 202210977083.4, filed on Aug. 15, 2022, the disclosure of which is incorporated by reference herein in its entirety as part of the present application.

TECHNICAL FIELD

The present disclosure relates to the technical field of metal materials, and more specifically, to a non-heat treated aluminum alloy stress-bearing member material with high toughness and high casting performance and its preparation method.

BACKGROUND ART

With the development of the application range of aluminum alloy, aluminum alloy materials are more widely used in the die casting industry. Die casting technology is a common casting technology in the production of aluminum alloy parts. According to the composition, die cast aluminum alloys are divided into Al—Si series, Al—Si—Mg series, Al—Si—Mn—Mg series, Al—Si—Cu series, Al—Mg series and Al—Zn series. Most die casting aluminum alloys, such as ADC12, A380 and other traditional die casting aluminum alloys, have problems of medium strength and poor toughness (elongation<5%). This is because the mechanical properties of traditional aluminum alloy materials cannot meet the standard requirements without heat treatment. However, the high-temperature solid solution heat treatment technology is very easy to cause the deformation of castings, especially large parts, and the subsequent rectification treatment needs to be carried out, so the product qualification rate is low. For example, Silafont-36 alloy (patent publication No.: U.S. Pat. No. 6,364,970B1) developed by TÜV Rheinland has good mechanical properties, but needs to adopt high vacuum and heat treatment process, which lengthens the whole process flow and consumes large costs. Shanghai Jiao Tong University has developed a non-heat-treated strengthened high strength and toughness die cast Al—Mg alloy (patent publication No.: CN104805322A). The alloy has excellent mechanical properties in the as-cast, but the Al—Mg alloy has poor casting properties and is not suitable for large structural parts.

Therefore, the development of a high-strength and high-toughness non-heat-treated die casting aluminum alloy to meet the increasing practical requirements of high-quality and high-performance aluminum alloy die casting in the die casting industry has become an urgent technical problem to be solved in the die casting field.

SUMMARY

In view of above, the first purpose of the present disclosure is to solve the problem that high-temperature solid solution heat treatment technology is easy to cause deformation of castings, especially large parts, and subsequent rectification treatment is required, resulting in a low product qualification rate. The present disclosure enables the alloy to obtain high mechanical properties in the as-cast by adding various strengthening elements, and based on this, a non-heat treated aluminum alloy stress-bearing member material with high toughness and high casting performance is provided.

In order to achieve the above purpose, technical solutions of the present disclosure are specifically described as follows.

A non-heat treated aluminum alloy stress-bearing member material with high toughness and high casting performance includes the following components in terms of mass percentage: Si: 8.5-12.0%, Mg: 0.10-0.35%, Mn: 0.25-0.4%, Cr: 0.02-0.14%, V: 0.02-0.38%, Sr: 0.01-0.04%, Ti: 0.05-0.11%, B≤0.005%, Ca≤0.05%, Zr≤0.1%, Zn≤0.1%, RE≤0.1%. The total amount of other impurities is less than or equal to 0.25%, and the balance is Al.

Preferably, the RE element is selected from one or a mixture of La, Ce and Sc elements.

Preferably, the tensile strength of the aluminum alloy material is not less than 260 MPa, the yield strength is not less than 140 MPa, and the elongation is not less than 12%.

It is worth noting that in the present disclosure, Cr element is added, and when Cr element is dissolved in the matrix as a solute atom, it can produce a solid solution strengthening effect on the alloy. Secondly, Cr element can change the needle-like Fe-containing phase in the alloy into granular, reduce its splitting effect, avoid stress concentration when stressed, and thus improve the elongation of the alloy. However, if the amount of the added Cr element is too large, the amount of Fe phase in the alloy will increase, which will increase the strength but decrease the elongation. Al—Si—Cr—Fe phase and $Al_7Cr$ phase and others dispersion phase can prevent dispersion slip, produce dispersion strengthening effect, inhibit recrystallization and grain growth, and enable the material to maintain high thermal stability during service.

In addition, in order to ensure that the die casting alloy is easy to demould, the traditional die casting alloy has a high Fe content. During solidification, Fe, together with Al, Si and other elements, forms needle like β-Fe phase, which is easy to produce stress concentration during the stress process, thus splitting the matrix and reducing the properties of alloy materials. In the present disclosure, in addition to Cr element, Mn element is added, and Mn element is used to replace part of Fe element. In addition to ensuring the demoulding effect, the improvement of Fe containing phase morphology by Mn can also be used to improve the performance, so that the elongation of the alloy can be improved without heat treatment. However, if the Mn content is too high, the number of Fe containing strengthening phases will increase and the elongation will decrease.

And the rare-earth elements as well as the master alloys formed by Al—Ti—B, Al—Zr and Al—V, such as $Al_4La$, $Al_4Ce$, $Al_1La_3$, $Al_1Ce_3$, $Al_3Sc$, $TiAl_3$, $TiB_2$, $Al_3Zr$, $Al_{11}V$, etc., can act as nucleation points of α-Al with the effect of refined grains. Rare-earth elements and Al—Sr also change eutectic silicon from lamellar to coral like or granular, all of which can improve alloy strength and plasticity at the same time. The dispersion rate of Sc element in aluminum matrix is slow, and the thermal stability is high, which improve the overall thermal stability of the alloy. V also has the effect of increasing the recrystallization temperature.

Further, Ca element has the effect of improving the morphology of eutectic silicon, the modification effect is good and the long-term modification can be realized. In addition, the price of Ca master alloy is low. The aluminum alloy provided by the present disclosure has a relatively high Si content, which will lead to an increase in the eutectic silicon content and higher requirements for its modification. In the present disclosure, using Sr, Ca and RE to modify eutectic silicon can achieve better modification effect. Meanwhile, the Si element is controlled at a higher level, close to the eutectic point, and in this range the alloy has both good casting and filling properties, as well as good contractility. But the excessive addition can lead to an increase in the amount of incipient silicon, which is not good for alloy elongation. And this range is suitable for large parts and filling complex structures.

Considering the recrystallization process of aluminum alloy, Mn added in this disclosure also increases the recrystallization temperature, prevents the recrystallization process of the aluminum alloy, and can significantly refine the recrystallized grains. The refinement of recrystallized grains is mainly achieved by the $MnAl_6$ compound diffuse mass points playing an impeding role on recrystallized grain growth. Mg element added in this disclosure is able to form $Mg_2Si$ strengthening phase with Si element to make the alloy a certain strength, but at the same time, too high Mg content added will lead to a dramatic decrease in alloy elongation.

The second purpose of the present disclosure is to provide a preparation method of the non-heat treated aluminum alloy stress-bearing member material with high toughness and high casting performance as described above.

A preparation method of the non-heat treated aluminum alloy stress-bearing member material with high toughness and high casting performance includes the following steps.

(1) Pretreatment: Al—Si, Al—Mn, Al—Cr, Al—V, Al—Sr, Al—Ti, Al—Ti—B, Al—Ca, Al—Zr, Al—Zn, Al—RE master alloy ingots and pure Al and pure Mg ingots are cut, ground and polished to remove oxide scale on the surface, and then weighed.

(2) Melting: A temperature of a crucible furnace is set and kept stable, then pure Al and Al—Si master alloy are placed in the crucible furnace to obtain a molten metal after the pure Al and Al—Si master alloy are completely melted. Al—Cr, Al—Mn, Al—Ti, Al—Ca, Al—Zn master alloys and pure Mg are added into the molten metal. The temperature of a molten aluminum is reduced for the first time after complete melting. Then the remaining master alloys are added after the temperature is stable. After preserving heat for 3-5 min, high-purity argon is injected into the molten metal for 10-12 min at a flow rate of 3-5 L/min with a vent nozzle is placed at a bottom of the molten metal. After degassing, it is allowed to stand for 3-5 minutes to remove surface dross.

(3) Casting: After the temperature of the molten aluminum is reduced for the second time, the molten metal is filtered and then transferred to the holding furnace of the casting machine. After the mold is put on line, the mold temperature controller is used for preheating, and the preheating temperature is 150-180° C. After that, a proper amount of molten aluminum is taken with a spoon and poured into the feeding cylinder, and a suitable injection process is set up for high-pressure die casting. During the process, the mold is vacuumed, and the pressure is relieved after a certain period of high-pressure holding. After the mold is kept for a period of time, the mold is opened and the casting is taken out before spraying operation. After the spraying operation is completed, the mold is closed to enter the next cycle. The whole casting cycle is 35-55 s.

It is worth noting that the present disclosure increases the strengthening elements in the matrix through the addition of various trace elements, reduces the grain size and the second phase size of the alloy, and improves the morphology of eutectic silicon and the second phase. Various strengthening factors lead to high performance of the alloy even without high-temperature solution, which avoids the use of heat treatment process and the deformation of castings, especially large parts, which is easily caused by high-temperature solid solution heat treatment. Furthermore, there is no need for rectification process, which simplifies the process flow, reduces the process cost, and improves the qualified rate of products.

Preferably, the temperature of the crucible furnace is 730~755° C.

Preferably, the temperature of the molten aluminum is reduced to 700~ 720° C. for the first time.

Preferably, the temperature of the molten aluminum is reduced to 650-690° C. for the second time.

Compared with the prior art, the non-heat treated aluminum alloy stress-bearing member material with high toughness and high casting performance of the present disclosure is mainly applied to the production of structural parts with large size, complex structure, high strength and toughness requirements, which are difficult to be heat treated. As cast, it can meet the production needs of automobile structural parts with tensile strength not less than 260 MPa, yield strength not less than 140 MPa and elongation not less than 12%. This alloy technology can break through the technical bottleneck of industrialization promotion, thus promoting the domestic production of aluminum alloy materials for high-performance structural parts in China, which is of great significance to promote the development of lightweight automobiles.

BRIEF DESCRIPTION OF THE DRAWINGS

In order to explain the embodiments of the present disclosure or the technical solutions in the prior art more clearly, the following drawings that need to be used in the description of the embodiments or the prior art will be briefly introduced. Obviously, the drawings in the following description are only embodiments of the present disclosure. For those of ordinary skill in the art, other drawings can be obtained based on the drawings disclosed without creative work.

DETAILED DESCRIPTION OF THE EMBODIMENTS

Figure 1:
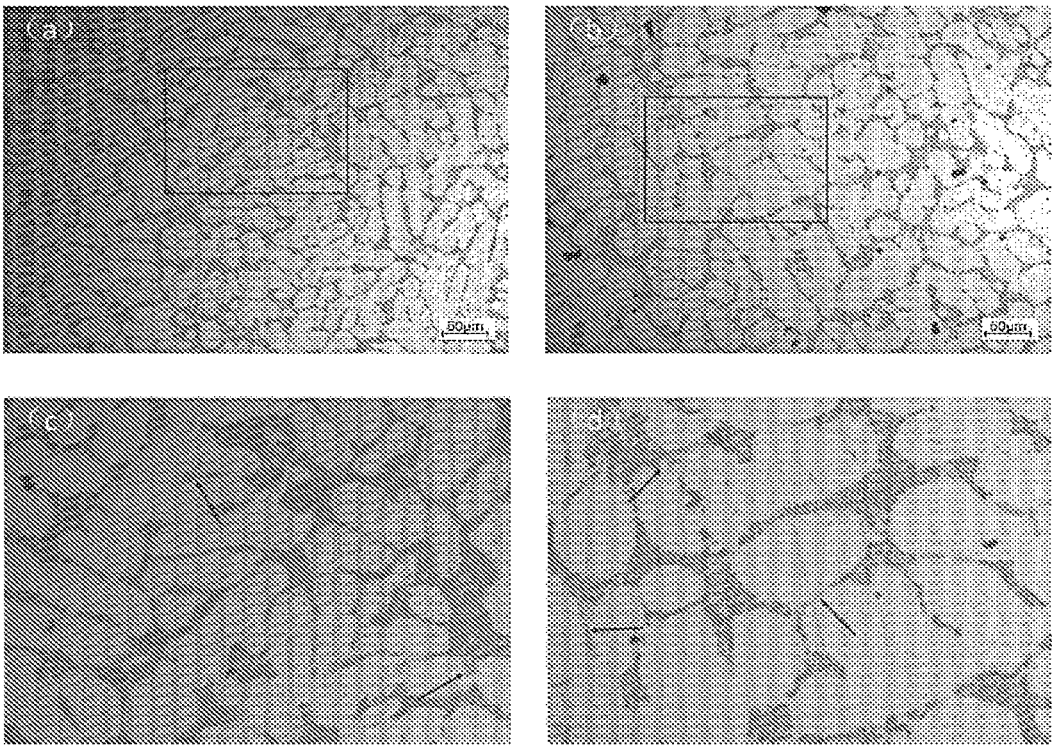
FIG. 1 is a picture of the microstructure of the non-heat treated aluminum alloy material in the as-cast in test experiment 1 of the present disclosure.

Technical solutions of the present disclosure will be clearly and completely described below with reference to the embodiments. Obviously, the described embodiments are only part of the embodiments of the present disclosure, not all of them. Other embodiments made by those skilled in the art without sparing any creative effort should fall within the scope of the disclosure.

The term "embodiment" used herein as an example does not necessarily mean that any embodiment described as "exemplary" is superior to or better than other embodiments. Unless otherwise specified, the performance index test in the embodiments of the application adopts the conventional test methods in the art. It should be understood that the terms described in this application are only for describing special embodiments and are not used to limit the contents disclosed in this application.

Unless otherwise specified, the technical and scientific terms used herein have the same meanings generally understood by those of ordinary skill in the art to which the application belongs.

Other unspecified test methods and technical means in this application refer to the test methods and technical means commonly used by ordinary technicians in the art.

The terms "basically" and "approximately" used in this application are used to describe small fluctuations. They may refer to, for example, less than or equal to ±5%, less than or equal to ±2%, less than or equal to ±1%, less than or equal to ±0.5%, less than or equal to ±0.2%, less than or equal to ±0.1% or less than or equal to ±0.05%. The numerical data expressed or presented in the range format in this application is only used for convenience and brevity, so it should be flexibly interpreted to include not only the numerical values explicitly listed as the boundaries of the range, but also all independent numerical values or sub ranges included in the range. For example, the numerical range of "1~5%" should be interpreted to include not only explicitly enumerated values of 1% to 5%, but also independent values and sub ranges within the exemplary range. Therefore, this numerical range includes independent values, such as 2%, 3.5% and 4%, and sub ranges, such as 1%~3%, 2%~4% and 3%~5%. This principle is also applicable to the range in which only one numerical value is listed. In addition, such an explanation applies regardless of the width of the range or the features.

In order to better illustrate the content of the present application, numerous specific details are given in the following specific embodiments. It should be understood by those skilled in the art that the present application may be practiced without certain specific details. In the embodiments, some methods, means, instruments, equipment, etc. that are well known to those skilled in the art are not described in detail, so as to highlight the gist of the present application.

The technical features disclosed in the embodiments of the present application may be arbitrarily combined on the premise of no conflict, and the obtained technical solution belongs to the content disclosed in the embodiments of the present application.

Embodiment 1

A non-heat treated aluminum alloy stress-bearing member material with high toughness and high casting performance is provided.

Mass percentage of each component element in the target alloy is as follows. Si: 10.5%, Mg: 0.18%, Mn: 0.3%, Cr: 0.08%, V: 0.12%, Sr: 0.025%, Ti: 0.09%, B: 0.002%, Ca: 0.02%, Zr: 0.06%, RE: 0.02%, and the balance is Al.

The Preparation Method Includes the Following Steps.

(1) Pretreatment: Al—Si, Al—Mn, Al—Cr, Al—V, Al—Sr, Al—Ti, Al—Ti—B, Al—Ca, Al—Zr, Al—RE master alloy ingots and pure Al and pure Mg ingots are cut, ground and polished to remove oxide scale on the surface, and then weighed.

(2) Melting: A temperature of a crucible furnace is set as 740° C. and kept stable, then pure Al and Al—Si master alloy are placed in the crucible furnace to obtain a molten metal after the pure Al and Al—Si master alloy are completely melted. Al—Cr, Al—Mn, Al—Ti, Al—Ca, Al—Zn master alloys and pure Mg are added into the molten metal. The temperature of a molten aluminum is reduced to 700° C. for after complete melting. Then the remaining master alloys are added after the temperature is stable.

After preserving heat for 5 min, high-purity argon is injected into the molten metal for 12 min at a flow rate of 4 L/min with a vent nozzle is placed at a bottom of the molten metal. After degassing, it is allowed to stand for 5 min to remove surface dross.

(3) Casting: The molten metal is filtered after the temperature of the molten aluminum is reduced to 660° C., and the filtered molten metal is poured into a mold preheated to 160° C., with a casting cycle of 35 s.

Embodiment 2

A non-heat treated aluminum alloy stress-bearing member material with high toughness and high casting performance is provided.

Mass percentage of each component element in the target alloy is as follows. Si: 8.5%, Mg: 0.35%, Mn: 0.4%, Cr: 0.02%, V: 0.38%, Sr: 0.01%, Ti: 0.09%, B: 0.005%, Ca: 0.05%, Zr: 0.1%, Zn: 0.08%, RE: 0.02%, and the balance is Al.

The Preparation Method Includes the Following Steps.

(1) Pretreatment: Al—Si, Al—Mn, Al—Cr, Al—V, Al—Sr, Al—Ti, Al—Ti—B, Al—Ca, Al—Zr, Al—Zn, Al—RE master alloy ingots and pure Al and pure Mg ingots are cut, ground and polished to remove oxide scale on the surface, and then weighed.

(2) Melting: A temperature of a crucible furnace is set as 730° C. and kept stable, then pure Al and Al—Si master alloy are placed in the crucible furnace to obtain a molten metal after the pure Al and Al—Si master alloy are completely melted. Al—Cr, Al—Mn, Al—Ti, Al—Ca, Al—Zn master alloys and pure Mg are added into the molten metal. The temperature of a molten aluminum is reduced to 720° C. after complete melting. Then the remaining master alloys are added after the temperature is stable. After preserving heat for 5 min, high-purity argon is injected into the molten metal for 12 min at a flow rate of 3 L/min with a vent nozzle is placed at a bottom of the molten metal. After degassing, it is allowed to stand for 3 min to remove surface dross.

(3) Casting: The molten metal is filtered after the temperature of the molten aluminum is reduced to 650° C., and the filtered molten metal is poured into a mold preheated to 170° C., with a casting cycle of 40 s.

Embodiment 3

A non-heat treated aluminum alloy stress-bearing member material with high toughness and high casting performance is provided.

Mass percentage of each component element in the target alloy is as follows. Si: 12%, Mg: 0.1%, Mn: 0.3%, Cr: 0.14%, V: 0.02%, Sr: 0.025%, Ti: 0.11%, Ca: 0.05%, Zr: 0.06%, Zn: 0.1%, RE: 0.02%, and the balance is Al.

The Preparation Method Includes the Following Steps.

(1) Pretreatment: Al—Si, Al—Mn, Al—Cr, Al—V, Al—Sr, Al—Ti, Al—Ti—B, Al—Ca, Al—Zr, Al—Zn, Al—RE master alloy ingots and pure Al and pure Mg ingots are cut, ground and polished to remove oxide scale on the surface, and then weighed.

(2) Melting: A temperature of a crucible furnace is set as 755° C. and kept stable, then pure Al and Al—Si master alloy are placed in the crucible furnace to obtain a molten metal after the pure Al and Al—Si master alloy are completely melted. Al—Cr, Al—Mn, Al—Ti, Al—Ca, Al—Zn master alloys and pure Mg are added into the molten metal. The temperature of a molten aluminum is reduced to 700° C. after complete melting. Then the remaining master alloys are added after the temperature is stable. After preserving heat for 3 min, high-purity argon is injected into the molten metal for 10 min at a flow rate of 5 L/min with a vent nozzle is placed at a bottom of the molten metal. After degassing, it is allowed to stand for 5 min to remove surface dross.

(3) Casting: The molten metal is filtered after the temperature of the molten aluminum is reduced to 690° C., and the filtered molten metal is poured into a mold preheated to 180° C., with a casting cycle of 55 s.

Embodiment 4

A non-heat treated aluminum alloy stress-bearing member material with high toughness and high casting performance is provided.

Mass percentage of each component element in the target alloy is as follows. Si: 9%, Mg: 0.2%, Mn: 0.25%, Cr: 0.14%, V: 0.2%, Sr: 0.04%, Ti: 0.05%, B: 0.002%, Zr: 0.06%, Zn: 0.08%, RE: 0.1%, and the balance is Al.

The Preparation Method Includes the Following Steps.

(1) Pretreatment: Al—Si, Al—Mn, Al—Cr, Al—V, Al—Sr, Al—Ti, Al—Ti—B, Al—Zr, Al—Zn, Al—RE master alloy ingots and pure Al and pure Mg ingots are cut, ground and polished to remove oxide scale on the surface, and then weighed.

(2) Melting: A temperature of a crucible furnace is set as 740° C. and kept stable, then pure Al and Al—Si master alloy are placed in the crucible furnace to obtain a molten metal after the pure Al and Al—Si master alloy are completely melted. Al—Cr, Al—Mn, Al—Ti, Al—Ca, Al—Zn master alloys and pure Mg are added into the molten metal. The temperature of a molten aluminum is reduced to 700° C. after complete melting. Then the remaining master alloys are added after the temperature is stable. After preserving heat for 5 min, high-purity argon is injected into the molten metal for 12 min at a flow rate of 5 L/min with a vent nozzle is placed at a bottom of the molten metal. After degassing, it is allowed to stand for 5 min to remove surface dross.

(3) Casting: The molten metal is filtered after the temperature of the molten aluminum is reduced to 660° C., and the filtered molten metal is poured into a mold preheated to 160° C., with a casting cycle of 35 s.

In order to further prove the beneficial effects of the present disclosure and better understand the present disclosure, the performance and preparation method of the non-heat treated aluminum alloy stress-bearing member material with high toughness and high casting performance disclosed in the present disclosure are further explained by the following comparative examples, but they are not intended to limit the disclosure. The product properties obtained from other comparative experiments made by those skilled in the art according to the above disclosure and the applications made according to the above properties are also considered to fall within the protection scope of the present disclosure.

Comparative Example 1

Mass percentage of each component element in the target alloy is as follows. Si: 10.5%, Mg: 0.18%, Mn: 0.65%, Sr: 0.025%, Ti: 0.09%, B: 0.002%, Ca: 0.02%, Zr: 0.06%, RE: 0.02%, and the balance is Al.

The preparation method includes the following steps.

(1) Pretreatment: Al—Si, Al—Mn, Al—Cr, Al—V, Al—Sr, Al—Ti, Al—Ti—B, Al—Ca, Al—Zr, Al—Zn, Al—RE master alloy ingots and pure Al and pure Mg ingots are cut, ground and polished to remove oxide scale on the surface, and then weighed.

(2) Melting: A temperature of a crucible furnace is set as 740° C. and kept stable, then pure Al and Al—Si master alloy are placed in the crucible furnace to obtain a molten metal after the pure Al and Al—Si master alloy are completely melted. Al—Cr, Al—Mn, Al—Ti, Al—Ca, Al—Zn master alloys and pure Mg are added into the molten metal. The temperature of a molten aluminum is reduced to 700° C. after complete melting. Then the remaining master alloys are added after the temperature is stable. After preserving heat for 5 min, high-purity argon is injected into the molten metal for 12 min at a flow rate of 4 L/min with a vent nozzle is placed at a bottom of the molten metal. After degassing, it is allowed to stand for 5 min to remove surface dross.

(3) Casting: The molten metal is filtered after the temperature of the molten aluminum is reduced to 660° C., and the filtered molten metal is poured into a mold preheated to 160° C., with a casting cycle of 35 s.

In order to further prove the beneficial effects of the present disclosure and better understand the present disclosure, the performance of the non-heat treated aluminum alloy stress-bearing member material with high toughness and high casting performance disclosed in the present disclosure are further explained by the following test experiment and experimental data, but they are not intended to limit the disclosure. The product properties obtained from other comparative experiments made by those skilled in the art according to the above disclosure and the applications made according to the above properties are also considered to fall within the protection scope of the present disclosure.

Test Experiment 1

The test samples were obtained from the materials obtained in embodiment 1 and comparative example 1 at the same position, and the test samples were inlaid, ground, and polished to obtain the metallographic sample blocks. The metallographic sample blocks were observed with a metallographic microscope, and the microstructure pictures were obtained. The results are shown in FIG. 1.

As can be seen from FIG. 1*a* and FIG. 1*b*, the secondary dendrite spacing in embodiment 1 is smaller than that in comparative example 1. From FIG. 1*c* and FIG. 1*d* (partial enlarged views of FIG. 1*a* and FIG. 1*b*), it is more obvious that there is a difference in the formation phase between the two dendrites (the gray particles indicated by the red arrows are Fe containing phase). Embodiment 1 shows that the interdendritic Fe containing phase is basically in the form of small particles, while the Fe containing phase in comparative example has a large overall size and some of it is needle shaped, which will lead to stress concentration during the stress process of the alloy, thus reducing the alloy performance.

Test Experiment 2

Figure 2:
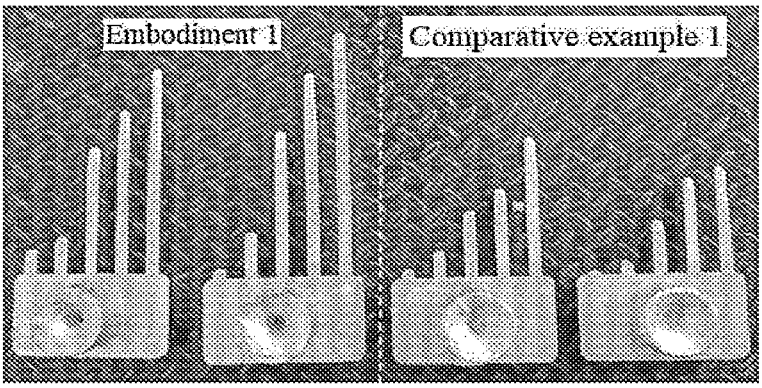
FIG. 2 is a flow test result chart of test experiment 2 of the present disclosure.

The molten aluminum obtained in embodiment 1 and comparative example 1 was poured into a fluidity mold at the same temperature, and the fluidity detection results were obtained. The results are shown in FIG. 2.

According to the fluidity detection law, the longer the distance of molten aluminum flowing in the mold, the better the fluidity of the alloy, the better the casting performance, and the easier it is to fill the cavity in the casting process. The mold temperature used in high-pressure casting process is lower, which requires higher casting performance. The fluidity of the embodiment in the disclosure is much higher than that of the comparative example, and its casting performance is excellent.

Test Experiment 3

Figure 3:
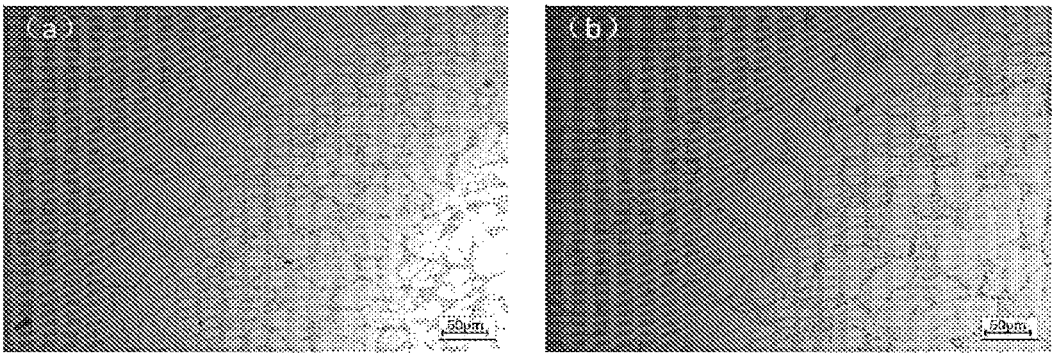
FIG. 3 is the microstructure picture after heat treatment at 500° C. for 2 h of test experiment 3 of the present disclosure.

The materials obtained in embodiment 1 and comparative example 1 were simultaneously kept at a furnace temperature of 500° C. for 2 h, and test samples were obtained at the same positions of the heat-treated samples of the two alloy materials. The test samples were inlaid, ground, and polished to obtain metallographic sample blocks. The metallographic sample blocks were observed with a metallographic microscope, and the microstructure pictures after being treated at high temperature for a period of time were obtained. The results are shown in FIG. 3.

It can be seen from the figures that after the high-temperature treatment of 500° C.*2*h*, the secondary dendrite spacing of embodiment 1 is not much different from that of FIG. 1*a*, while the secondary dendrite spacing of comparative example is significantly increased compared with that of FIG. 1*b*. It shows that the grain size in embodiment 1 did not change significantly at high temperature, but that in the comparative example changed greatly. It is further explained that the structure of the alloy in embodiment 1 is relatively stable during service at high temperatures. This is mainly because Cr and SC elements and the generated second phase have thermal stability. During the high-temperature service of the material, they prevent the grain growth, stabilize the performance of the alloy, and expand the application field of this alloy in the future.

Test Experiment 4

The as-cast test bars obtained in embodiments 1 to 4 and comparative example 1 were tested for tensile mechanical properties at room temperature. The test bars were prepared into the standard test bars according to the national standard, and the tensile property of the material was tested at room temperature with a tensile tester. Five test bars per group were tested and averaged to obtain the data in Table 1

The test results show that embodiment 1 has the highest elongation and embodiment 4 has the best comprehensive performance according to the difference of the effects of various trace elements. The strength and elongation of comparative example 1 were generally worse than those of embodiment 1, because the elements added in embodiment 1 made the alloy grain finer, the size of the second phase between dendrites smaller, and the roundness higher, that is, the microstructure was more excellent.

TABLE 1

Test results of tensile mechanical properties at room temperature

| Group | Performance | | |
|---|---|---|---|
| | Yield strength/Mpa | Tensile strength/Mpa | Elongation/% |
| Embodiment 1 | 160.32 | 273.45 | 17.20 |
| Embodiment 2 | 169.92 | 284.21 | 14.96 |
| Embodiment 3 | 164.28 | 278.34 | 15.83 |
| Embodiment 4 | 174.56 | 285.37 | 15.99 |
| Comparative example | 142.81 | 255.47 | 10.12 |

The above description of the disclosed embodiments enables the skilled in the art to achieve or use the disclosure. Multiple modifications to these embodiments will be apparent to those skilled in the art, and the general principles defined herein may be achieved in other embodiments without departing from the spirit or scope of the disclosure. The present disclosure will therefore not be restricted to these embodiments shown herein, but rather to comply with the broadest scope consistent with the principles and novel features disclosed herein.

What is claimed is:

1. A non-heat treated aluminum alloy stress-bearing member material, comprising the following components in terms of mass percentage: Si: 8.5-12.0%, Mg: 0.10-0.35%, Mn: 0.25-0.4%, Cr: 0.02-0.14%, V: 0.02-0.38%, Sr: 0.01-0.04%, Ti: 0.05-0.11%, B≤0.005%, 0≤Ca≤0.05%, 0≤Zr≤0.1%; Zn≤0.1%, RE≤0.1%; a total amount of other impurities is less than or equal to 0.25%, and the balance is Al.

2. The non-heat treated aluminum alloy stress-bearing member material of claim 1, wherein the RE element is selected from one or a mixture of La, Ce and Sc elements.

3. The non-heat treated aluminum alloy stress-bearing member material of claim 1, wherein a tensile strength of the aluminum alloy material is not less than 260 MPa, a yield strength is not less than 140 MPa, and an elongation is not less than 12%.

4. A preparation method of the non-heat treated aluminum alloy stress-bearing member material with high toughness and high casting performance of claim 1, comprising the following steps:

(1) pretreatment: cutting Al—Si, Al—Mn, Al—Cr, Al—V, Al—Sr, Al—Ti, Al—Ti—B, Al—Ca, Al—Zr, Al—Zn, Al—RE master alloy ingots and pure Al and pure Mg ingots, grinding and polishing to remove oxide scale on the surface, and weighing the same;

(2) melting: setting a temperature of a crucible furnace and keeping the temperature stable, placing pure Al and Al—Si master alloy in the crucible furnace, obtaining a molten metal after the pure Al and Al—Si master alloy are completely melted, adding Al—Cr, Al—Mn, Al—Ti, Al—Ca, Al—Zn master alloys and pure Mg into the molten metal, reducing a temperature of a molten aluminum for the first time after complete melting, adding remaining master alloys after the temperature is stable, preserving heat for 3-5 min, injecting high-purity argon into the molten metal for 10-12 min at a flow rate of 3-5 L/min with a vent nozzle is placed at a bottom of the molten metal, and leaving for 3-5 min after degassing to remove surface dross; and (3) casting: filtering the molten metal after the temperature of the molten aluminum is reduced for the second time, and pouring the filtered molten metal into a mold preheated to 150-180° C., with a casting cycle of 35-55 s.

5. The preparation method of claim 4, wherein the temperature of the crucible furnace is 730~755° C.

6. The preparation method of claim 4, wherein the temperature of the molten aluminum is reduced to 700~720° C. for the first time.

7. The preparation method of claim 4, wherein the temperature of the molten aluminum is reduced to 650-690° C. for the second time.

* * * * *